US006561728B1

(12) United States Patent
Seantier

(10) Patent No.: US 6,561,728 B1
(45) Date of Patent: May 13, 2003

(54) METHOD FOR PRODUCING A ROAD JOINT, AND JOINT OBTAINED BY THE METHOD

(75) Inventor: Jacky Seantier, Chartres (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/719,341

(22) PCT Filed: Apr. 5, 2000

(86) PCT No.: PCT/FR00/00847

§ 371 (c)(1),
(2), (4) Date: Dec. 11, 2000

(87) PCT Pub. No.: WO00/61872

PCT Pub. Date: Oct. 19, 2000

(30) Foreign Application Priority Data

Apr. 9, 1999 (FR) ..... 99 04469

(51) Int. Cl.[7] ..... E01D 19/06; E01C 11/02

(52) U.S. Cl. ..... 404/68; 404/47; 404/74; 14/73.1

(58) Field of Search ..... 14/73.1; 404/47, 404/48, 67, 68, 74

(56) References Cited

U.S. PATENT DOCUMENTS

| | | | | | |
|---|---|---|---|---|---|
| 3,104,600 | A | * | 9/1963 | White | 29/283 |
| 3,474,581 | A | * | 10/1969 | Gery | 264/34 |
| 3,824,025 | A | * | 7/1974 | Beutler | 404/48 |
| 5,024,554 | A | * | 6/1991 | Benneyworth et al. | 404/47 |
| 5,088,256 | A | * | 2/1992 | Face, Jr. | 404/64 |
| 5,171,100 | A | * | 12/1992 | Bergstedt et al. | 403/225 |
| 5,513,927 | A | * | 5/1996 | Baker et al. | 404/47 |
| 5,649,784 | A | | 7/1997 | Ricaud et al. | |
| 5,664,906 | A | * | 9/1997 | Baker et al. | 404/47 |

FOREIGN PATENT DOCUMENTS

| | | |
|---|---|---|
| DE | 1279918 | 5/1963 |
| EP | 0000642 | 2/1979 |
| EP | 0161148 | 11/1985 |
| EP | 0459061 | 12/1991 |
| FR | 1380667 | 3/1965 |
| GB | 1020180 | 2/1966 |
| GB | 1318805 | 5/1973 |
| WO | WO 9624726 | 8/1996 |
| WO | WO 9952981 | 10/1999 |

* cited by examiner

*Primary Examiner*—Gary S. Hartmann
(74) *Attorney, Agent, or Firm*—Cantor Colburn LLP

(57) ABSTRACT

The joint is installed between two sections of roadway respectively supported by two contiguous structural elements. A driving surface is formed by a surface covering applied on top of the elements and interrupted above the gap separating them to form a trench. A closure member is placed in the base of the trench covering the gap, after which granulates and a binder which form a flexible material on curing are poured in. Before pouring in the granulates and binder, reinforcements are laid in the trench which are attached to the two structural elements at either end of the closure member. These reinforcements are perforated to allow the granulates to pass through. They therefore provide reinforcement for the joint in areas where there is a risk of tearing due to traction forces which tend to move the elements apart.

19 Claims, 1 Drawing Sheet

METHOD FOR PRODUCING A ROAD JOINT, AND JOINT OBTAINED BY THE METHOD

TECHNICAL FIELD

The present invention relates to the field of flexible road joints of the type comprising a flexible material resulting from a mixture of granulates and binder, used to fill a trench formed in a road surface on a level with a gap between two structural elements supporting the surface covering.

BACKGROUND OF THE INVENTION

Flexible joints of this type are used between successive sections of the deck of a bridge, for example, where the amplitude of gap movements (gusting wind) between these sections is not too high. They provide an economic solution and also ensure continuity in the driving surface and good acoustic comfort.

The compositions used to make such joints are more often than not based on a thermoplastic binder. By way of example, European patent 0 000 642 describes a flexible joint with a base of bitumen and rubber scrap as a binder whilst French patent 2 562 108 describes a joint made using a binder based on bitumen and an elastomer vulcanised with sulphur.

Binders based on two components have also become available, in which the flexible matrix is made by cross-linking products respectively incorporated in the two components. The advantage of these formulations is that they can be used at ambient temperature, which makes works easier to carry out.

Improvements in the materials used in the binder composition have made joints less sensitive to softening, which tends to give rise to ruts across the road surface. Striking a better compromise between the flexibility of the joint and its sensitivity to softening has meant that joints of this type can be used for works where exposure to gusting wind is likely to be higher.

However, the joint remains fragile when subjected to traction due to gap movement between the two adjacent roadway supports. The flexible material is at risk of tearing away from its support close to the edge of the surfacing, which reduces continuity in the road surface as well as the closure function of the joint. This risk is even greater if using this type of joint in even higher winds.

A main objective of this invention is to improve the behaviour of such a flexible joint when subjected to traction forces.

SUMMARY OF THE INVENTION

Accordingly, the invention proposes a method of forming a flexible joint between two sections of roadway, supported respectively by two contiguous structural elements, a roadway surface being formed by a surface covering applied on top of the structural elements and interrupted above a gap separating the two structural elements to form a trench of a width greater than that of said gap. In accordance with this method, a closure member covering said gap is placed in the base of the trench and granulates and a binder are poured into the trench which form a flexible material on curing. Before pouring in the granulates and binder, reinforcements are laid in the trench which are attached to the two structural elements at either end of the closure member, these reinforcements being perforated to allow at least some of the granulate mixture to pass through.

The reinforcements allow the joint to be reinforced in areas where the risk of tearing under traction forces is greatest. The fact that the reinforcements are perforated allows the granulates and binder to pass through the reinforcement from either side and into its midst. The resultant reinforcing effect is efficient.

In one particularly advantageous embodiment, the binder is made up of several components, preferably including a polyurethane, mixed and used at ambient temperature.

In specific modes of implementing the method:

- each reinforcement has a convex portion resting on the bed of the trench;
- each reinforcement has a first portion resting on the bed of the trench and a second portion applied along an end surface of the surface covering bordering the trench;
- each reinforcement is a piece of unfurled metal;
- in order to attach the reinforcements, holes are bored in the structural elements at the base of the trench, metal rods are inserted in these holes with their top ends left projecting so that they can be inserted through the perforated reinforcements and the top ends of the rods are folded down over the top of the reinforcements;
- the closure member is coated with grease;
- the closure member comprises at least two flexible sheets one on top of the other, which are disposed so that they overlap along the direction perpendicular to the gap separating the two structural elements, the side edges of the closure member, disposed substantially parallel with the gap, belonging to separate sheets.

One of the sheets is preferably disposed so that it covers the entire gap separating the two structural elements.

Another aspect of the invention relates to a joint for a flexible roadway between two sections of roadway respectively supported by two contiguous structural elements, a roadway surface being formed by a surface coating applied on top of the structural elements and interrupted above a gap separating the two structural elements to form a trench of a width greater than that of the gap. The flexible joint is located in the trench and comprises a closure member covering said gap at the base of the trench and a mixture of granulates and flexible binder. It additionally comprises perforated reinforcements, attached to the two structural elements at either end of the closure member and embedded in the mixture of granulates and binder.

DESCRIPTION OF THE PREFERRED EMBODIMENTS

Figure 1:
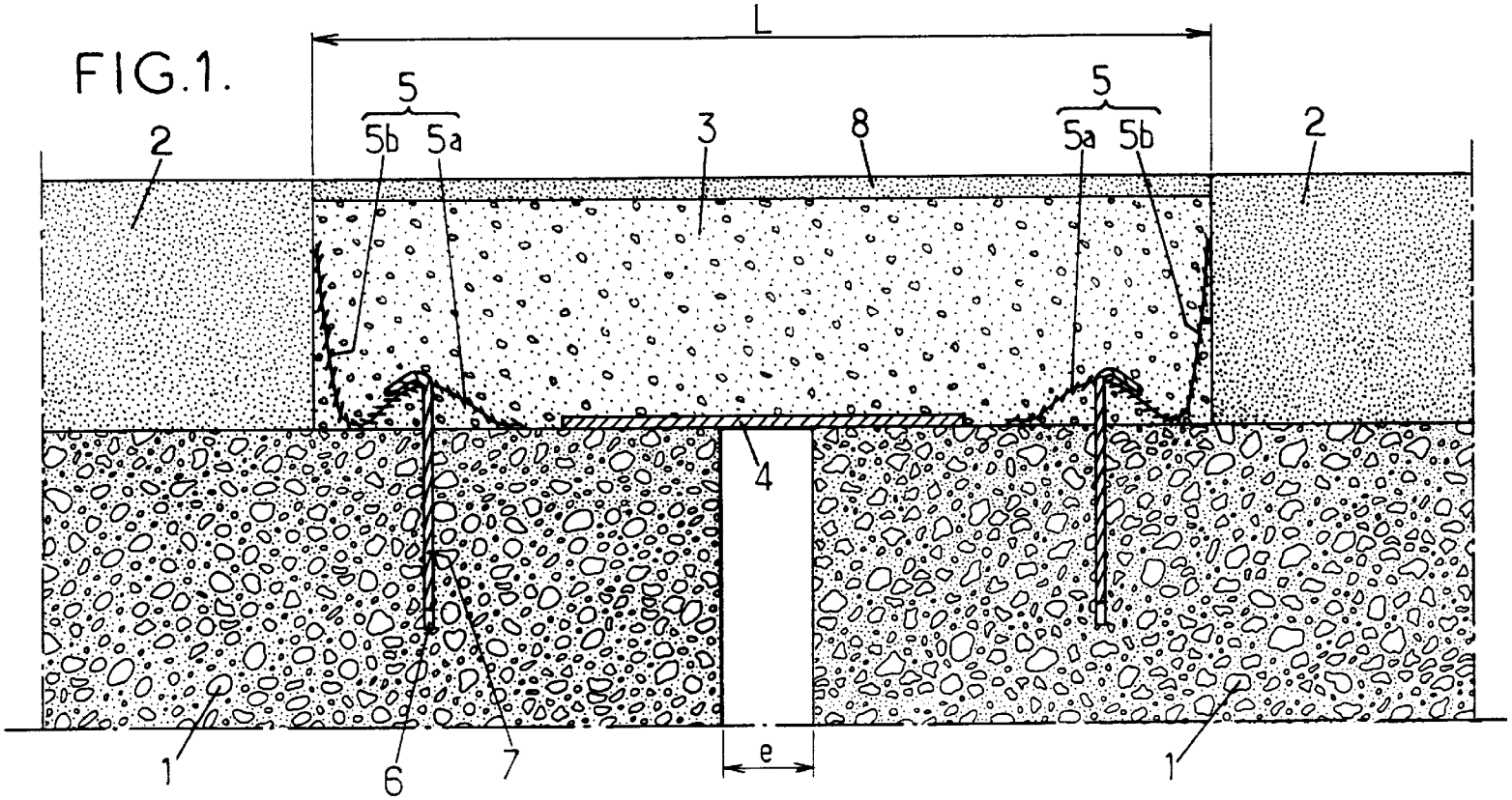
FIG. 1 is a view in cross section of a flexible joint formed as proposed by the invention.

The roadway, illustrated on a level with a joint illustrated in FIG. 1, is constructed on elements 1 made from concrete, for example. If the roadway is on a bridge, the elements 1 may be sections of the bridge deck and/or abutments. Displacements may occur between the contiguous elements 1 and a gap is therefore left between them, the thickness e of which will typically vary between 10 and 60 mm.

In order to form the driving surface of the roadway, a conventional surface covering 2 is applied on top of the elements 1. This surface covering 2 is interrupted above the gap between the two elements 1 defining a trench of a width L which is wider than e. By way of example, the width L of the trench, divided symmetrically across the two sides of the gap e, may be from 25 to 70 cm.

The purpose of this trench is to receive the flexible joint proposed by the invention, which comprises a mixture 3 of granulates and flexible binder, a member 4 for closing off the gap e and reinforcements 5.

The binder used in the flexible material 3 may be of any known composition. In a preferred embodiment, it will be a dual-component binder which forms a flexible matrix by a chemical reaction between the molecules contained in the two components at ambient temperature. In particular, this matrix may have a polyurethane base, completed by bitumen.

In the example illustrated in FIG. 1, the closure member 4 is a metal sheet, placed on the gap e at the base of the trench. It prevents the granulates and binder from infiltrating this gap. The bottom face of the sheet 4 also permits a degree of sliding between the concrete elements 1 in order to distribute compression on the joint across a greater width. The width of this sheet 4 is 10 to 35 cm for example.

The reinforcements 5 are disposed on each side of the trench, on either side of the closure sheet 4. These reinforcements 5 are perforated to allow at least some of the granulates in the mixture 3 to pass through. Accordingly, certain granulates coated with binder will pass behind the reinforcements 5 and others will remain in their orifices. Once the binder has cured, the reinforcements 5 will then be firmly retained in the flexible material 3.

The reinforcements 5 are attached to the concrete elements 1 at each side of the trench in order to procure a resistance to tearing in the flexible material 3 of the joint in areas subjected to traction whenever the elements 1 have a tendency to move apart from one another.

FIG. 1 illustrates a simple and convenient means of fixing the reinforcements 5. Cylindrical holes 6 are firstly bored into the concrete of the elements 1 and metal rods 7 are then inserted in these holes 6. The rods 7 are of a diameter slightly larger than that of the holes 6, for example, and are pushed into them by force. The top end of the rods 7 are left projecting into the trench and once the reinforcements 5 are laid, the projecting ends of the rods 7 are pushed through the openings provided in the reinforcements 5.

FIG. 1 also illustrates a preferred section of the reinforcements 5 which will generally extend across the entire length of the joint (perpendicular to the plane of FIG. 1).

The reinforcement 5 is preferably made from an unfurled metal sheet or mesh having orifices of an appropriate size (a few centimetres) and shaped to conform to the contour illustrated.

A first portion 5*a* of the reinforcement is laid on the base of the trench between the closure sheet 4 and the edge of the surface covering 2. This portion 5*a* is convex in shape to allow the material 3, including the granulates, to pass between the reinforcement and the surface of the concrete element 1. The convex portion 5*a* is typically of a height of between 2 to 3 centimetres. It allows any traction forces to be transmitted into the flexible material 3 in advance of its interface with the surface covering 2. Because it is close to this interface that the risk of tearing is highest, it imparts improved resistance to the joint.

A second portion 5*b* of the reinforcement is laid along the end surface of the surface covering 2 bordering the trench. This portion 5*b* provides reinforcement in its most fragile area and distributes the reinforcing effect across its thickness. The width of the first portion 5*a* is 8 to 10 centimetres for example and the height of the second portion 5*b* may be in the order of half that of the surface covering 2.

After having positioned the closure sheet 4 and the reinforcements 5, the material 3 is then applied. For example, a layer of granulates may be laid and the prepared binder poured on in the fluid state until the layer of granulates is totally embedded, this operation being repeated up to the level of the surface covering 2. A layer of grit 8 is then spread on to give the joint a surface aspect similar to that of the surface covering 2.

The closure sheet 4 is advantageously coated with a grease, for example a silicon, to facilitate sliding between the concrete elements 1 and to prevent the material 3 from adhering,. Clearly, care must be taken to ensure that this grease does not spill beyond the end of the sheet. It is of advantage if the sheet 4 is wide enough to distribute compression on the joint over a greater width. However, it is preferable to prevent the edges of the sheet 4 from moving into abutment against the reinforcements 5 when the elements 1 move closer together.

Figure 2:
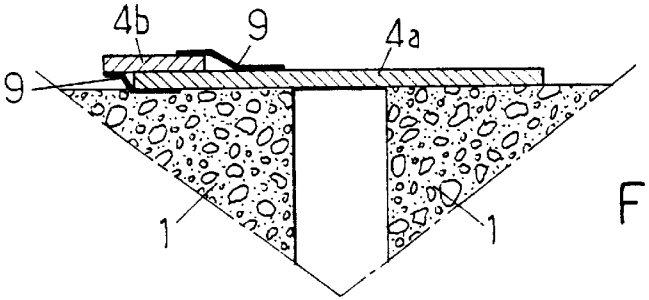
FIG. 2 is a partial view in cross section of another embodiment of the joint.

To this end, this closure member is divided into two parts (or more) one on top of the other, disposed parallel with the gap separating the two concrete elements 1 so as to overlap in the direction perpendicular to this gap, as illustrated in FIG. 2. The side edges of the closure member, made up of two sheets 4*a*, 4*b*, belong to separate sheets. The widest sheet 4*a* is supported on the two elements 1 and is covered by the sheet 4*b* of lesser width which extends beyond one of the ends. Adhesive tape 9 may be used to assemble the two sheets 4*a*, 4*b*. Accordingly, when the elements 1 are displaced, the two sheets 4*a*, 4*b* coated with grease are able to slide one on top of the other, preventing them from moving into abutment against the reinforcements 5. This arrangement also prevents the side edges of the closure member from piercing or deforming the flexible material 3 excessively whenever the elements 1 move towards one another.

What is claimed is:

1. Method of forming a flexible joint between two sections of roadway respectively supported by two contiguous structural elements, a driving surface being formed by a surface covering applied on top of the structural elements and interrupted above a gap separating the two structural elements to form a trench having a width greater than a width of said gap, the method comprising the steps of:

placing a closure member at a bottom of the trench to cover said gap;

installing reinforcements in the trench, and attaching said reinforcements on either side of the closure member;

pouring granulates and a binder into the trench so that the granulates and binder arc disposed over said gap; and allowing said granulates and binder to cure, thereby forming a flexible material, whereby said reinforcements are perforated to allow at least some of the granulates to pass therethrough.

2. Method as claimed in claim 1, wherein each reinforcement has a convex portion lying at the bottom of the trench.

3. Method as claimed in claim 1, wherein each reinforcement has a first portion lying at the bottom of the trench and a second portion laid along an end surface of the surface covering bordering the trench.

4. Method as claimed in claim 1, wherein each reinforcement comprises a piece of stretched metal grid.

5. Method as claimed in claim 1, wherein the reinforcements are attached in a process comprising:

boring holes into the structural elements at the bottom of the trench, inserting metal rods said holes, whereby upper ends of said rods are left projecting in the trench, inserting the top ends of the rods through the perforated reinforcements, and folding down the upper ends of the rods over the reinforcements.

6. Method as claimed in claim 1, wherein the binder is made up of several components mixed and applied at ambient temperature.

7. Method as claimed in claim 6, wherein the components of the binder include a polyurethane.

8. Method as claimed in claim 1, wherein the closure member is coated with grease.

9. Method as claimed in claim 1, wherein the closure member comprises at least two superimposed sheets overlapping along a direction perpendicular to the gap separating the two structural elements so that side edges of the closure element, disposed substantially parallel with the gap, belong to distinct sheets.

10. Method as claimed in claim 9, wherein one of the sheets is arranged to completely cover the gap separating the two structural elements.

11. Flexible road joint between two sections of roadway respectively supported by two contiguous structural elements, a driving surface being formed by a surface covering applied on top of the structural elements and interrupted above a gap separating the two structural elements to form a trench having a width greater than a width of said gap, the flexible joint being located in the trench and comprising: a closure member covering said gap at a bottom of the trench and i mixture of granulates and flexible binder are disposed over said gap; perforated reinforcements attached to the two structural elements at either side of the closure member and embedded in the mixture of granulates and binder.

12. Joint as claimed in claim 11, wherein each reinforcement has a convex portion lying at the bottom of the trench.

13. Joint as claimed in claim 11 wherein each reinforcement has a first portion lying at the bottom of the trench and a second portion laid along an end surface of the surface covering bordering the trench.

14. Joint as claimed in claim 11, wherein each reinforcement comprises a piece of stretched metal grid.

15. Joint as claimed in claim 11, wherein the reinforcements are fixed to the structural elements by means of metal rods inserted in holes bored into the structural elements at the bottom of the trench, said metal rods having upper ends projecting into the trench and inserted through perforated reinforcements over which they are folded down.

16. Joint as claimed in claim 11, wherein the flexible binder comprises a mixture of bitumen and polyurethane.

17. Joint as claimed in claim 11, wherein the closure member is coated with grease.

18. Joint as claimed in claim 11, wherein the closure member comprises at least two superimposed sheets which overlap transversely to the gap separating the two structural elements and wherein the side edges of the closure member, disposed substantially parallel with the gap, belong to distinct ones of the sheets.

19. Joint as claimed in claim 18, rein one of the sheets completely covers the gap between the two structural elements.

* * * * *